US008485621B2

(12) United States Patent
Fioravanti et al.

(10) Patent No.: US 8,485,621 B2
(45) Date of Patent: Jul. 16, 2013

(54) SOLID INKJET DRUM MAINTENANCE UNIT (DMU) EMPLOYING ADJUSTABLE BLADE CAM IN ORDER TO CONTROL THE OIL RATE

(75) Inventors: Alexander J. Fioravanti, Penfield, NY (US); Paul J. McConville, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 239 days.

(21) Appl. No.: 13/043,920

(22) Filed: Mar. 9, 2011

(65) Prior Publication Data

US 2012/0229536 A1 Sep. 13, 2012

(51) Int. Cl.

| | |
|---|---|
| ***B41J 2/195*** | (2006.01) |
| ***B41J 2/17*** | (2006.01) |
| ***B41J 2/175*** | (2006.01) |
| ***B41J 2/01*** | (2006.01) |

(52) U.S. Cl.
USPC ..... 347/7; 347/84; 347/86; 347/103

(58) Field of Classification Search
USPC ..... 347/7, 9, 88, 103, 33, 84, 86
See application file for complete search history.

(56) References Cited

U.S. PATENT DOCUMENTS

| | | | | |
|---|---|---|---|---|
| 4,656,577 | A | 4/1987 | Herman | |
| 5,805,191 | A * | 9/1998 | Jones et al. | 347/103 |
| 5,808,645 | A * | 9/1998 | Reeves et al. | 347/103 |
| 7,458,671 | B2 | 12/2008 | Leighton et al. | |
| 7,634,220 | B2 | 12/2009 | Asakura et al. | |
| 7,677,717 | B2 | 3/2010 | Islam et al. | |
| 7,699,459 | B2 | 4/2010 | Gault et al. | |
| 7,731,347 | B2 | 6/2010 | Gordon et al. | |
| 2007/0146461 | A1 * | 6/2007 | Islam et al. | 347/103 |
| 2010/0053261 | A1 | 3/2010 | Thayer et al. | |
| 2010/0053293 | A1 * | 3/2010 | Thayer et al. | 347/103 |
| 2010/0054830 | A1 | 3/2010 | Thayer et al. | |
| 2010/0079561 | A1 | 4/2010 | Derimiggio et al. | |
| 2010/0231674 | A1 | 9/2010 | Domoto et al. | |

OTHER PUBLICATIONS

United Kingdom Search Report of the Intellectual Property Office corresponding to Application No. GB1203972.3, South Wales, United Kingdom, Jun. 26, 2012 (3 pages).

* cited by examiner

*Primary Examiner* — Jason Uhlenhake

(74) *Attorney, Agent, or Firm* — Maginot, Moore & Beck, LLP

(57) ABSTRACT

A printing device is configured to adjust the angle of a metering blade within a predetermined range of angles to compensate for wear in the blade over time or for other causes of inconsistency. The angle of the metering blade is selected by a controller which operates an actuator to move a moveable member to adjust the angle of the metering blade and regulate the thickness of a release agent layer on a moving imaging member.

16 Claims, 2 Drawing Sheets

SOLID INKJET DRUM MAINTENANCE UNIT (DMU) EMPLOYING ADJUSTABLE BLADE CAM IN ORDER TO CONTROL THE OIL RATE

TECHNICAL FIELD

This disclosure relates generally to imaging devices having intermediate transfer surfaces, and, in particular, to maintenance systems for such intermediate transfer surfaces.

BACKGROUND

Solid inkjet imaging systems generally use an electronic form of an image to distribute ink melted from a solid ink stick or pellet in a manner that reproduces the electronic image. In some solid inkjet imaging systems, the electronic image may be used to control the ejection of ink directly onto a media sheet. In other solid inkjet imaging systems, the electronic image is used to operate printheads to eject ink onto an intermediate imaging member. A media sheet is then brought into contact with the intermediate imaging member in a nip formed between the intermediate member and a transfer roller. The heat and pressure in the nip help transfer the ink image from the intermediate imaging member to the media sheet, which is transported from the system and deposited in a paper tray.

In solid ink imaging systems having intermediate imaging members, ink is loaded into the system in a solid form, either as pellets or as ink sticks, and transported through a feed chute by a feed mechanism for delivery to a melting device. The melting device heats the solid ink to its melting temperature and the liquid ink is delivered to a printhead for jetting onto an intermediate imaging member. In the print head, the liquid ink is typically maintained at a temperature that enables the ink to be ejected by the printing elements in the print head, but that preserves sufficient tackiness for the ink to adhere to the intermediate imaging member. In some cases, however, the tackiness of the liquid ink may cause a portion of the ink to remain on the intermediate imaging member after the image is transferred onto the media sheet and the residual ink may later degrade other ink images formed on the intermediate imaging member.

To address the accumulation of ink on an intermediate imaging member, which may be in the form of a drum, solid ink imaging systems may be provided with a drum maintenance unit (DMU). In solid ink imaging systems, the DMU is configured to 1) lubricate the image receiving surface of the intermediate imaging member with a very thin, uniform layer of release agent before each print cycle, and 2) remove and store any excess release agent, ink and debris from the surface of the intermediate imaging member after each print cycle. During each print cycle, the release agent deposited on the intermediate imaging member may be controlled with a flexible metering blade. The metering blade is designed to distribute release agent on, and possibly remove excess release agent from, the intermediate imaging member so the release agent does not degrade the media sheet in the nip.

Metering blades wear over time, causing excess release agent or an uneven layer of release agent on the intermediate imaging drum. An incorrect or inconsistent amount of release agent applied to the surface of the intermediate imaging drum may result in some of the solid ink adhering to the imaging drum or in excess release agent being transferred to the media. The consequences of problems in forming the release agent layer may produce print quality defects, such as smudging or poor image fixation. Preservation of the components for metering release agent and cleaning the imaging surface in a solid ink printer is desirable.

SUMMARY

A printing device has been developed that provides a layer of release agent having a thickness in a predetermined range over the operational life of the device. The device includes a moving imaging member, a printhead configured to eject melted solid ink towards the moving imaging member, a source of release agent, an applicator that is configured to receive release agent from the source of release agent and to move from a first position where the applicator does not engage a surface of the moving imaging member to a second position where the applicator engages the surface of the moving imaging member to apply release agent to the surface of the moving imaging member, a metering blade that is positioned to enable the metering blade to distribute release agent applied to the surface of the moving imaging member by the applicator, a moveable member that is operatively connected to the metering blade, the moveable member being configured to vary an angle of the metering blade with respect to the surface of the moving imaging member to enable the metering blade to form a layer of release agent having a thickness in a predetermined range on the surface of the moving ink receiving member to facilitate transfer of the melted solid ink from the moving imaging member onto media, the moveable member being configured to vary the angle of the metering blade through a plurality of predetermined angles between the metering blade and the surface of the moving imaging member, an actuator that is operatively connected to the moveable member and configured to move the moveable member and vary an angle of the metering blade to the moving imaging member through the plurality of predetermined angles, and a controller operatively connected to the actuator, the controller being configured to operate the actuator to move the moveable member and position the metering blade at an angle selected from the plurality of predetermined angles to distribute release agent on the moving imaging member at a thickness corresponding to an operational life of the metering blade.

A method of operating a printing device has been developed that provides a layer of release agent having a thickness in a predetermined range over the operational life of the device. The method includes applying release agent from a source of release agent to a surface of a moving imaging member that is positioned opposite a printhead that ejects melted solid ink towards the moving imaging member, selecting an angle between a metering blade and the moving imaging member from a plurality of predetermined angles between the metering blade and the moving imaging member, operating an actuator to move a moveable member and position the metering blade operatively connected to the moveable member at the selected angle to enable the metering blade to distribute a layer of release agent on the moving imaging member with a thickness in a predetermined range on the surface of the moving ink receiving member that corresponds to an operational life of the metering blade, operating the printhead to eject melted solid ink on the layer of release agent formed on the moving imaging member, and transferring the melted ink on the layer of release agent to media.

BRIEF DESCRIPTION OF THE DRAWINGS

The foregoing aspects and other features of the present disclosure are explained in the following description, taken in connection with the accompanying drawings, wherein.

DETAILED DESCRIPTION

Figure 1:
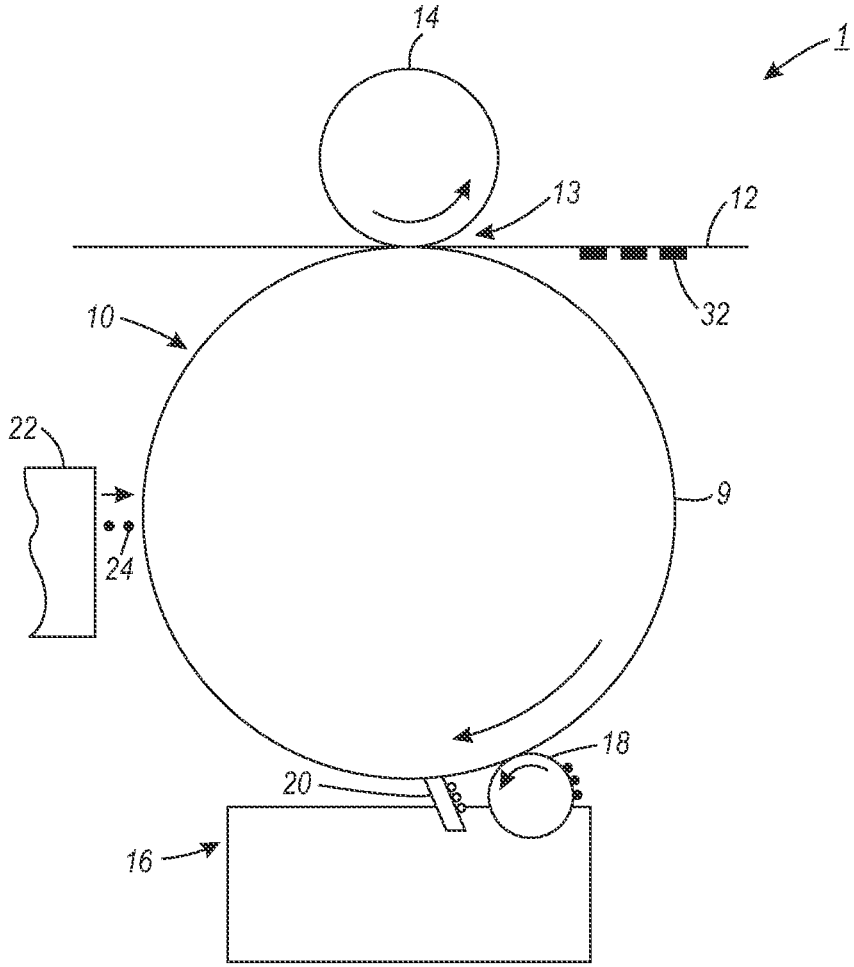
FIG. 1 (Prior Art)
FIG. 1 is a schematic diagram of an embodiment of an inkjet printing device in the related art including a DMU.

For a general understanding of the present embodiments, reference is made to the drawings. In the drawings, like reference numerals have been used throughout to designate like elements. As used herein, the terms "printer," "printing device" or "imaging device" generally refer to a device for applying an image to print media and may encompass any apparatus, such as a digital copier, bookmaking machine, facsimile machine, multi-function machine, etc. which performs a print outputting function for any purpose. "Print media" can be a usually flimsy physical sheet of paper, plastic, or other suitable physical print media substrate for images. A "print job" or "document" is normally a set of related sheets, usually one or more collated copy sets copied from a set of original print job sheets or electronic document page images, from a particular user, or otherwise related. As used herein, the term "consumable" refers to anything that is used or consumed by an imaging device during operations, such as print media, marking material, release agent, and the like. An image generally may include information in electronic form which is to be rendered on the print media by the image forming device and may include text, graphics, pictures, and the like. The operation of applying images to print media, for example, graphics, text, photographs, etc., is generally referred to herein as printing or marking.

Referring now to FIG. 1, an embodiment of a prior art printing device 1 is illustrated to show a printing device configuration that enables an ink image 24 to be formed with melted solid ink on a layer of release agent on a rotating imaging member (shown as a drum 10 in FIG. 1) and then transferred to a print medium or other receiving substrate 12. During formation of an ink image, the transfix roll 14 is positioned so the roll 14 does not contact the surface 9 of the drum 10. As the drum 10 turns in the direction indicated by the arrow in the drum, a release agent is deposited onto a surface 9 of the drum 10 by a drum maintenance unit (DMU) 16. The release agent is applied to the surface 9 of the drum 10 to facilitate the transfer of the ink image 24 to the print medium 12. The print medium 12 may be any known print media, such as paper, transparent film, or the like. The DMU 16 has an applicator 18 that is configured to contact the surface 9 and apply release agent to the surface 9 of the drum 10. In this prior art device, the applicator 18 is shown as a roll, however, as discussed below in more detail, the applicator 18 may be in a number of different forms. The DMU 16 also has a metering blade 20 that is configured to move into and out of contact with the surface 9, but the angle between the metering blade and the surface 9 remains fixed. The metering blade 20 is brought into contact with the release agent to distribute the release agent applied to the surface 9 and form a thin film of release agent on the drum 10.

After the drum 10 is coated with the release agent, an inkjet device 22 ejects ink towards the surface of the drum 10 to form an ink image 24 on top of the release agent layer. One or more revolutions of the imaging member or drum 10 may be required to form ink image 24. After the ink image is completed, the transfix roll 14 is moved to engage the surface 9 of the drum 10 as the ink image approaches the nip 13 formed by the transfix roll 14 and the drum 10. The print media 12 approaches the nip 13 in synchronization with the ink image 24 so the print media 12 and the ink image 24 pass through the nip 13 at the same time. In this manner, the ink image 24 is transferred from the surface 9 of the drum 10 to the print media 12 to form a final image 32.

Figure 2:
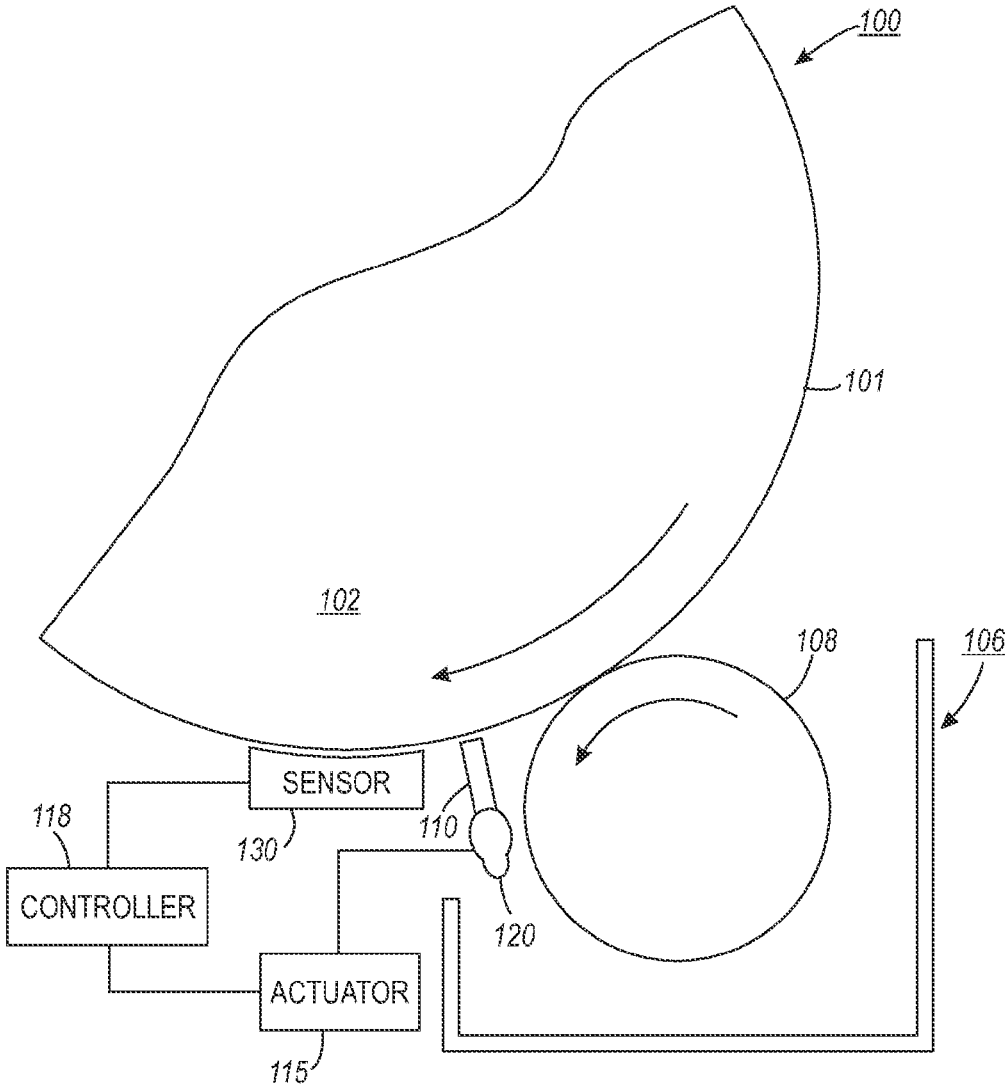
FIG. 2 is a schematic diagram of an inkjet printing device with a DMU like that of FIG. 1 that further includes a moveable member operatively connected to a metering blade to vary the angle of the metering blade with respect to the imaging member.

Referring now to FIG. 2, an improved inkjet printing device 100 is shown. In device 100, a DMU 106 includes a metering blade 110 and a moveable member 120 that is operatively connected to the metering blade 110 and configured to vary the angle of the metering blade to the surface of the imaging member 102. In this embodiment, the angle of the metering blade 110 to the imaging member 102 is adjusted by operation of the moveable member 120. As discussed below in more detail, the moveable member 120 is moved by an actuator 115, which responds to signals generated by controller 118 in either a closed-loop or an open-loop system.

As illustrated, the applicator 108 is in the form of a roll, which is formed from an absorbent material, such as extruded polyurethane foam. The roll absorbs the release agent received from a source (not shown) located in the DMU 106 and applies it to the surface 101 of the rotating imaging member (shown as drum 102 in FIG. 2). In alternative embodiments, the applicator 108 may be any device that can apply a release agent to the rotating imaging member 102. For example, the applicator 108 may be in the form of a sled, a blotter, or a blade. Additionally, the source of the release agent may be any source that can provide the release agent to the applicator 108 as required for application to the imaging member. For example, the release agent source may be a remote reservoir tank, an adjacent reservoir, or an internal source within the applicator 108. Furthermore, the release agent may be delivered to the applicator 108 by, for example, direct contact, a pump, a wick, a drip bar, or a capillary.

As discussed generally above, once the release agent is applied to surface 101 of the rotating imaging member 102 by the applicator 108, the metering blade 110 removes excess release agent and distributes release agent uniformly across the surface 101 to form a film of release agent on the rotating imaging member 102. The thickness of the release agent film is dependent upon the angle of the metering blade 110 with respect to the surface 101 of the rotating imaging member 102. If the metering blade 110 is angled perpendicularly to the surface 101, the amount of surface area contact between the metering blade 110 and the surface 101 is greater than the amount of surface area contact that occurs when the metering blade is positioned at lesser angles. The amount of release agent that can be removed by the blade 110 from the imaging member 102 is directly proportional to amount of surface area contact occurring between the metering blade and the imaging member. Accordingly, if the angle of the metering blade 110 with respect to the surface 101 is controlled, the thickness of the release agent film on the imaging member is also controlled.

Controlling the thickness of the release agent film on the surface 101 by adjusting the angle of the metering blade 110 preserves the surface of the imaging member for printing and the quality of the images transferred to media. In previously known solid ink printers, issues may arise as the metering blades wear and the consistency of the release agent layer on the imaging member begins to vary. Specifically, as a printing device 100 is used, the metering blade 110 wears due, for example, to contact with the surface 101. Adjusting the angle of the metering blade 110 from a shallower angle to a steeper angle with respect to the imaging member surface enables the amount of surface area contact between the metering blade 110 and the imaging member 102 to increase and to continue to remove the same amount of release agent from the surface 101 as the worn metering blade 110 did at the shallower angle. When the printing device 100 is new, the metering blade 110 is positioned at a relatively shallow angle to the surface 101. As the blade wears, the controller 118 operates the actuator 115 to position the metering blade 110 at a steeper angle relative to the surface 101. Thus, the thickness of the release agent film on the surface 101 can be maintained within a predetermined range over the lifetime of the solid ink printing device 100.

In the embodiment shown in FIG. 2, the angle of the metering blade 110 relative to the surface 101 is accomplished by the controller 118 operating the actuator 115 to move a moveable member 120, which is operatively connected to the blade 110. As shown in the figure, the moveable member 120 is a cam that is operatively connected to the rotational mechanical output of the actuator 115. In other embodiments, the moveable member 120 may be any device capable of adjusting the angle of the metering blade 110 relative to the surface 101. For example, in one embodiment, the moveable member is a spring that is operatively connected at one end to the moveable member 120 and at another end to the linear mechanical output of an actuator. In another embodiment, the moveable member is a lever that is operatively connected at one end to the moveable member 120 and at another end to the linear mechanical output of the actuator 115. In another embodiment, the moveable member is a threaded shaft that is operatively connected at one end to the moveable member and at another end to the linear mechanical output of an actuator. Other mechanisms may be used provided the combination of components in the mechanism are arranged to vary the angle of the blade with reference to the surface of the imaging member 102. The mechanical output of the actuator enables the moveable member to be moved and this movement changes the angle of the blade 110 with respect to the surface of the imaging member 102.

The actuator may be further operatively connected to a controller to enable the controller to generate signals that operate the actuator and change the angle of the metering blade with respect to the surface of the imaging member. The controller 118 is configured with programmed instructions and electronic interface components to enable the controller to operate the actuator and position the metering blade 110. The controller 118 is also configured to generate a signal that operates the actuator 115 to produce mechanical movement and position the metering blade at a selected angle. For example, in one embodiment, the controller 118 generates an electrical signal that enables a current to pass through a coil of a solenoid to close a pair of contacts that enable electrical power to be supplied to the actuator. The actuator in this embodiment is an electrical motor, such as a stepper motor, that produces rotational movement on an output shaft that is mechanically connected to the moveable member 120, such as the cam shown in FIG. 2. The controller 118 outputs the signal to the solenoid for a predetermined period of time that corresponds to predetermined amount of rotational movement on the output shaft. The movement of the output shaft of the actuator 115 is mechanically connected to the moveable member 120 to move member 120 by a predetermined distance that positions the metering blade 110 at the angle selected by the controller.

The controller 118 selects the angle at which to position the metering blade 110 from a predetermined range of angles. The range of predetermined angles is selected based on the amount of wear that the metering blade 110 undergoes and the amount of the release agent desired on the surface 101. The amount of the release agent film desired on the surface 101 is also selected from a predetermined range of release agent amounts. The range of predetermined release agent amounts on the surface 101 is based on empirically derived data of inkjet printers using varying amounts of release agent. The amount of release agent may be, in one embodiment, two to ten milligrams of release agent per sheet. The amount of release agent may be, in another embodiment, three to eight milligrams of release agent per sheet and, in another embodiment, the amount of release agent per sheet may be in the range of three to five milligrams. The controller 118 then selects the appropriate angle at which to position the metering blade 110 to achieve an amount of release agent within the appropriate range and generates the signals that operate the actuator to position the blade at this angle.

In one embodiment, the controller 118 may be part of an open-loop system to adjust the angle of the metering blade. In this embodiment, the controller 118 is configured to count the number of times the metering blade 110 has been positioned to form a layer of release agent on the surface 101. The number of times corresponds to an amount of wear that the metering blade 110 has experienced. Thus, the controller 118 selects a position for the metering blade 110 at an angle relative to the surface 101 to compensate for the wear appropriately. The controller 118 then operates the actuator 115 to move the moveable member 120 and position the metering blade 110 accordingly. The metering blade 110 may wear to a steady state level, after which the controller 118 no longer repositions the metering blade 110.

In an alternative embodiment, the controller 118 may be part of a closed-loop system. In this embodiment, the controller 118 is configured with programmed instructions and electronic interface components to receive sensor signals indicative of the thickness of the release agent layer on the imaging surface and to select an angle at which to position the metering blade 110. In another embodiment, the sensor signals indicate the amount of release agent present in the release agent source in the DMU 106 and the controller is configured to identify an amount of blade wear corresponding to the remaining amount of release agent in the DMU. In a closed-loop system based on the thickness of the release agent layer on the surface 101, the controller is configured to receive a signal from a sensor 130, which is positioned proximate the surface 101. The sensor 130 generates a signal corresponding to the thickness of the release agent layer. In one embodiment, the sensor 130 is an optical signal that includes a light generator that directs light towards the surface of the imaging member and a light receiver that is positioned to receive light reflected from the imaging surface. The light receiver responds to the amount or intensity of the light reflected by the imaging surface to generate an electrical signal that, in one embodiment, has an amplitude that corresponds to the amount or intensity of the reflected light received by the sensor. The sensor signal indicates a thickness of the release agent layer on the surface 101. The controller compares this signal to one or more thresholds to determine whether the release agent is at an expected level or within an expected range. If the controller determines the release agent is not at an expected level or within an expected range, the controller selects an appropriate angle for the metering blade and operates the actuator to vary the angle of the metering blade to the imaging member 102.

In one embodiment, the sensor signal amplitude detected by the controller may be compared to an upper threshold and a lower threshold. If the sensor signal amplitude is less than the upper threshold and greater than the lower threshold, the controller does not operate the actuator as the release agent level is within the range identified by the upper threshold and the lower threshold. If the sensor signal amplitude is greater than the upper threshold, the controller determines the angle of the blade to the imaging surface needs to be reduced to lower the thickness of the release agent layer or the amount of release agent on the imaging member 102. On the other hand, if the sensor signal amplitude is less than the lower threshold, the controller determines the angle of the blade to the imaging surface needs to be increased to increase the thickness of the release agent on the imaging surface or the amount of release agent on the imaging member 102. The controller 118 generates a signal to operate the actuator 115 and move the blade 110 to a position that corresponds to the angle selected by the controller 118. Thus, the controller 118 adjusts the angle of the blade with respect to the imaging member to regulate the release agent layer thickness on the imaging surface. In this way, the controller appropriately compensates for wear or other factors affecting the release agent metering performed by the blade 110.

In a closed-loop system based on the amount of release agent present in the release agent source in the DMU 106, the controller is configured with programmed instructions and electronic interface components to receive a signal from a sensor (not shown) positioned in the release agent source. The sensor may be a level sensor in one embodiment that generates a signal indicating whether release agent is being detected by the sensor. A plurality of such sensors can be arranged in one embodiment to indicate an approximate level of release agent as being between one sensor that generates a signal indicative of release agent being detected and another sensor that generates a signal indicative of release agent not being detected. Once the controller 118 identifies the release agent level as being at a position that corresponds to a number of metering blade operations for blade wear, the controller 118 selects an appropriate angle for the metering blade and generates a signal to operate the actuator 115 and move the moveable member 120 to position the metering blade 110 at the selected angle. In another embodiment, a level sensor is positioned at a predetermined position that corresponds to an amount of release agent having been removed from the source. In response to the sensor generating a signal indicating no release agent is being sensed, the controller selects an angle for the metering blade and generates a signal to operate the actuator 115 and move the moveable member 120 to position the metering blade 110 at the selected angle.

In operation, the system described above changes the angle of the metering blade 110 in order to control the amount of release agent on the surface 101 and maintain constant performance of the device 100 over time. This system compensates for the degradation of performance of the metering blade 110 and may extend the life of the DMU 106 while requiring less maintenance than in previous devices.

It will be appreciated that variations of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A printing device comprising:

a moving imaging member;

a printhead configured to eject melted solid ink towards the moving imaging member;

a source of release agent;

an applicator that is configured to receive release agent from the source of release agent and to move from a first position where the applicator does not engage a surface of the moving imaging member to a second position where the applicator engages the surface of the moving imaging member to apply release agent to the surface of the moving imaging member;

a metering blade that is positioned to enable the metering blade to distribute release agent applied to the surface of the moving imaging member by the applicator;

a moveable member that is operatively connected to the metering blade, the moveable member being configured to vary an angle of the metering blade with respect to the surface of the moving imaging member to enable the metering blade to form a layer of release agent having a thickness in a predetermined range on the surface of the moving ink receiving member to facilitate transfer of the melted solid ink from the moving imaging member onto media, the moveable member being configured to vary the angle of the metering blade through a plurality of predetermined angles between the metering blade and the surface of the moving imaging member;

an actuator that is operatively connected to the moveable member and configured to move the moveable member and vary an angle of the metering blade to the moving imaging member through the plurality of predetermined angles; and a controller operatively connected to the actuator, the controller being configured to identify an accumulated count of times that the metering blade has been moved to distribute release agent on the surface of the moving imaging member, to select an angle for positioning the metering blade from the plurality of predetermined angles with reference to the identified accumulated count of times, and to operate the actuator to move the moveable member and position the metering blade at the selected angle to distribute release agent on the moving imaging member at a thickness corresponding to an operational life of the metering blade.

2. The printing device of claim 1 wherein the controller is further configured to operate the actuator with open loop control to position the moveable member.

3. The printing device of claim 2, the controller being further configured to select the angle at which the metering blade is positioned to maintain a layer of release agent on the surface of the moving imaging member that has a thickness within the predetermined range over an operational life of the printing device.

4. The printing device of claim 1 wherein the controller is further configured to operate the actuator with closed loop control to position the moveable member.

5. The printing device of claim 4 further comprising:

a sensor positioned proximate the surface of the moving imaging member and positioned at a location that enables the sensor to generate an electrical signal corresponding to a thickness of release agent on the surface of the moving imaging member; and the controller is operatively connected to the sensor to receive the signal generated by the sensor and the controller being further configured to select the angle at which the metering blade is positioned with reference to the electrical signal received from the sensor.

6. The printing device of claim 4 further comprising:

a level sensor positioned within the source of release agent, the sensor being configured to generate an electrical signal corresponding to the sensor detecting release agent; and the controller is operatively connected to the sensor to receive the signal generated by the sensor and the controller being further configured to select the angle at which the metering blade is positioned with reference to the electrical signal received from the sensor.

7. The printing device of claim 4, the controller being further configured to select the angle to maintain a layer of release agent having a thickness within the predetermined range on the surface of the moving ink receiving member over an operational life of the printing device.

8. The printing device of claim 1 wherein the moveable member is a cam with an eccentric lobe that is positioned to engage the metering blade and vary the angle of the metering blade as the eccentric lobe rotates with respect to the metering blade.

9. The printing device of claim 1 wherein the moveable member is a spring operatively connected at one end to the metering blade and at a second end to the actuator.

10. The printing device of claim 1 wherein the moveable member is a lever operatively connected at one end to the metering blade and at a second end to the actuator.

11. A method for operating a printing device comprising:

applying release agent from a source of release agent to a surface of a moving imaging member that is positioned opposite a printhead that ejects melted solid ink towards the moving imaging member;

identifying an accumulated count of times that a metering blade has been moved to distribute release agent applied to the surface of the moving imaging member;

selecting an angle between a metering blade and the moving imaging member from a plurality of predetermined angles between the metering blade and the moving imaging member, the angle being selected with reference to the identified accumulated count of times;

operating an actuator to move a moveable member and position the metering blade operatively connected to the moveable member at the selected angle to enable the metering blade to distribute a layer of release agent on the moving imaging member with a thickness in a predetermined range on the surface of the moving ink receiving member that corresponds to an operational life of the metering blade;

operating the printhead to eject melted solid ink on the layer of release agent formed on the moving imaging member; and transferring the melted ink on the layer of release agent to media.

12. The method of claim 11, the actuator operation further comprising:

operating the actuator with open loop control to move the moveable member and position the metering blade.

13. The method of claim 11, the actuator control further comprising:

operating the actuator with close loop control to move the moveable member and position the metering blade.

14. The method of claim 13, the angle selection further comprising:

selecting the angle at which the metering blade is positioned with reference to an electrical signal received from a sensor that is configured to detect a thickness of a release agent layer on the moving imaging member.

15. The method of claim 13, the angle selection further comprising:

a sensor positioned within the source of release agent, the sensor being configured to generate an electrical signal corresponding to the sensor detecting release agent; and selecting the angle at which the metering blade is positioned with reference to the electrical signal received from the sensor positioned with the source of release agent.

16. The method of claim 11, the selection of the angle at which the metering blade is positioned further comprising:

selecting the angle to maintain a layer of release agent on the surface of the moving imaging member that has a thickness within a predetermined range over an operational life of the printing device.

* * * * *